US011193633B2

(12) United States Patent
Li et al.

(10) Patent No.: US 11,193,633 B2
(45) Date of Patent: Dec. 7, 2021

(54) LED LAMP WITH GRAPHENE RADIATOR

(71) Applicants: HUZHOU MINGSHUO OPTOELECTRONIC TECHNOLOGY CO., LTD., Huzhou (CN); TUNGHSU OPTOELECTRONIC TECHNOLOGY CO., LTD., Hebei (CN)

(72) Inventors: Heran Li, Hebei (CN); Qing Li, Hebei (CN); Wei Chen, Hebei (CN)

(73) Assignees: HUZHOU MINGSHUO OPTOELECTRONIC TECHNOLOGY CO., LTD., Huzhou (CN); TUNGHSU OPTOELECTRONIC TECHNOLOGY CO., LTD., Hebei (CN)

( * ) Notice: Subject to any disclaimer, the term of this patent is extended or adjusted under 35 U.S.C. 154(b) by 0 days.

(21) Appl. No.: 16/612,394

(22) PCT Filed: Dec. 26, 2017

(86) PCT No.: PCT/CN2017/118682
§ 371 (c)(1),
(2) Date: Nov. 10, 2019

(87) PCT Pub. No.: WO2018/205634
PCT Pub. Date: Nov. 15, 2018

(65) Prior Publication Data

US 2020/0158295 A1 May 21, 2020

(30) Foreign Application Priority Data

May 10, 2017 (CN) ..... 2017 2 0516 122 U

(51) Int. Cl.
*F21V 29/74* (2015.01)
*F21K 9/237* (2016.01)
(Continued)

(52) U.S. Cl.
CPC ..... *F21K 9/237* (2016.08); *F21S 2/005* (2013.01); *F21V 29/745* (2015.01); *F21V 31/005* (2013.01); *F21Y 2115/10* (2016.08)

(58) Field of Classification Search
None
See application file for complete search history.

(56) References Cited

U.S. PATENT DOCUMENTS

2013/0106064 A1* 5/2013 Okuda ..... F16J 15/122 277/591
2014/0240989 A1* 8/2014 Hardikar ..... F21V 29/89 362/294
(Continued)

FOREIGN PATENT DOCUMENTS

CN 102620269 A 8/2012
CN 102634212 A 8/2012
(Continued)

*Primary Examiner* — Keith G. Delahoussaye
(74) *Attorney, Agent, or Firm* — Myers Wolin, LLC.

(57) ABSTRACT

A graphene heat-dissipation LED lamp, comprising an LED light source module, a power supply module, a lamp housing (9) and a waterproof power strip (22). The LED light source module is connected to the power supply module by means of the power strip (22) to form an LED module assembly. A graphene heat-conducting material is added to the LED module, so that the heat conduction efficiency is improved and the service life is prolonged. In addition, the lighting performance of the LED lamp is further improved. By configuring independent modules and using a quick connector, the LED lamp can be quickly mounted without a disassembling tool.

11 Claims, 5 Drawing Sheets

(51) Int. Cl.

| | |
|---|---|
| ***F21S 2/00*** | (2016.01) |
| ***F21V 31/00*** | (2006.01) |
| *F21Y 115/10* | (2016.01) |

(56) References Cited

U.S. PATENT DOCUMENTS

| | | | | |
|---|---|---|---|---|
| 2014/0240994 | A1* | 8/2014 | Lim | F21K 9/23 362/382 |
| 2015/0176831 | A1* | 6/2015 | Zhang | F21S 8/085 362/294 |

FOREIGN PATENT DOCUMENTS

| | | | |
|---|---|---|---|
| CN | 102818177 | A | 12/2012 |
| CN | 103131274 | A | 6/2013 |
| CN | 104726069 | A | 6/2015 |
| CN | 105650613 | A | 6/2016 |
| CN | 103474566 | B | 8/2016 |
| JP | 2014510407 | A | 4/2014 |
| JP | 2015526855 | A | 9/2015 |
| KR | 20130135600 | A | 12/2013 |
| WO | WO 2018/205634 | | 11/2018 |

* cited by examiner

LED LAMP WITH GRAPHENE RADIATOR

RELATIONSHIP TO OTHER APPLICATIONS AND INCORPORATION BY REFERENCE

This application claims priority to and the benefit of PCT/CN2017/118682 filed Dec. 26, 2017 and of CN2017/20516122.5 filed May 10, 2017. All patent disclosures and publications disclosed herein are hereby incorporated by reference for all allowable purposes under law as though the entire publication(s) were present in the application verbatim.

TECHNICAL FIELD

The present invention belongs to the technical field of illumination, and in particular relates to a new Graphene heat-dissipation LED lamp.

BACKGROUND

In the process of urbanization, street lamps represent a very important link in the construction. According to statistics, the consumption for lighting accounts for about 20% of the national electricity consumption currently. China's annual electricity for lighting is close to 250 billion kWh, a large part of which is due to the power consumption of urban street lamps. Reducing the electricity consumption for road lighting is an important part of energy conservation in urban construction.

At present, the most commonly used lighting fixtures on urban roads are sodium lamps. A sodium lamp as a street lamp provides good road visibility at night. Its orange light is penetrating and soft in the fog and the objects under this kind of light can be seen clearly. Therefore, sodium gas lamps are used to reduce traffic accidents on main roads and for artificial lighting.

The structure of a sodium lamp is as shown in FIG. 1. It consists of a casing 1, a bracket 2, a ballast 3, a lamp base bracket 4, a lamp base 5, a light source tube 6, a cover 7, and a reflector 8. The casing 1 is divided into an upper casing and a lower casing, and the upper casing and the lower casing form a hollow casing 1. The reflector 8 is fixedly mounted on the lower casing by screws, and is located inside the casing 1. A circular opening is provided at the tail of the reflector 8 for the light source tube 6 to pass through. The cover 7 is fixedly mounted on the lower casing by screws and the pressers corresponding to the reflector 8, and is located outside the casing 1.

As shown in FIG. 2, the ballast 3 is fixedly mounted on the bracket 2 by screws. The lamp base bracket 4 is externally attached to the bracket 2. The lamp base 5 is mounted on the lamp base bracket 4 and is connected to the light source tube 6. The bracket 2 is fixed to the lower casing of the casing 1 by screws. The lamp base bracket 4, the lamp base 5 and the light source tube 6 pass through the circular opening at the tail of the reflector 8 and are located in a closed space formed by the reflector 8 and the cover 7.

The working principle of the sodium lamp is as follows: when the bulb is switched on, an arc is generated between the electrodes at the two ends of the light source tube 6; due to the high temperature of the arc, the liquid sodium-mercury amalgam within the tube is evaporated into mercury vapour and sodium vapour; the electrons emitted from the cathode impinge on the atoms of the discharge material during the movement toward the anode; the atoms obtain the energy for ionization or excitation, and then return to the ground state from the excited state; or the ionized atoms are excited, and then return to the ground state, forming an infinite loop. At this time, excess energy is released in the form of light radiation, producing light.

Although sodium lamps are the most commonly used street lamps, they still have the following defects: 1. high power consumption and low power efficiency; 2. low colour temperature and poor colour rendering; 3. low light source utilization ratio; 4. long start-up time, and inability to be started continuously; 5. not environment friendly (containing mercury); 6. short service life; and 7. complex disassembly, and inconvenient replacement and maintenance.

Since the light source tube used in a sodium lamp emits light 360 degree, a reflector is provided for the reflection of a part of the light and a large amount of light energy will be wasted in the reflection process. Although the sodium lamp can meet the lighting requirements, it cannot solve the problem of energy saving in the urban road construction process.

With the establishment of a resource-conserving and environment-friendly society in recent years, the concept of "green lighting" is gradually gaining popularity. With the continuous advancement of science and technology, and the rapid development of application technology of semiconductor materials, low-power LED light sources have been widely used in landscape lighting, and high-power LED street lamps have also attracted more and more attention from all sides.

Compared with the traditional sodium lamp, an LED lamp can save about 55% of the energy. The colour temperature of the LED lamp can be flexibly selected from a range of 1900K to 7000K, and the colour rendering index can be as high as 70 or above, while the colour of the light emitted by the traditional sodium lamp is yellow with a low colour rendering index. The bulb structure of the sodium lamp determines its low light output rate, which is only about 60%, but the LED lamp has a high light output rate, which can be up to 88%-95%. A bulb of a high-pressure sodium lamp has long start-up time and needs a certain time interval before starting up again, while the LED lamp does not have the start-up delay problem, can be turned on and work at any time. LED is a solid light source without any gas. The LED lamp does not contain mercury or lead, has no ultraviolet ray, and will neither cause harm to the human body nor pollute the environment (it can also be recycled and reused). The theoretical life of an LED is about 100,000 hours and the theoretical life of the traditional sodium lamp is only about 6,000 hours.

Although LED street lamps have many advantages over sodium lamps, they still have some shortcomings. First of all, regardless of whether it is a high-power LED street lamp or a high-temperature sodium lamp, due to structural limitations, it is very inconvenient to replace the lamp, especially for the large-scaled replacement in urban road construction, which will seriously restrict the construction and development of street lamps. The realization of quick and convenient replacement is an urgent problem to be solved.

On the other hand, for high-power LED street lamps, heat dissipation is also very important for their application. The performance life of an LED is greatly affected by temperature, and thus heat dissipation is a non-negligible problem. If the heat dissipation problem cannot be solved, the loss of the LED street lamp will be intensified, which will affect its normal use.

SUMMARY

In order to overcome the above-mentioned technical problems, the present invention provides a novel LED light source module, an LED module assembly, and a graphene heat-dissipation LED lamp. By adding and encapsulating a graphene heat-conducting material to the light source of the LED street lamp, the heat conduction efficiency of the light source is improved and the service life is prolonged, and in addition, the lighting efficiency of the LED street lamp is further improved. In contrast to the inconvenience in disassembly and replacement of traditional street lamps, the present invention can be quickly installed without a disassembling tool, by providing standalone modules and using a quick connector.

In particular, the present invention relates to the following contents:

1. An LED light source module, comprising: a sunflower radiator and an LED light source.

2. The light source module according to item 1, wherein a block structure formed of a graphene phase-change material is filled in the middle of the sunflower radiator.

3. The light source module according to item 1 or 2, wherein the surface of the sunflower radiator is coated with a graphene-containing fluororesin material.

4. The light source module according to any one of items 1 to 3, wherein the LED light source is connected to the sunflower radiator through graphene-containing heat-conducting silicone grease.

5. The light source module according to any one of items 1 to 4, wherein the LED light source module further comprises a lens, a rubber ring, a pressing ring, a back cover, a platform, a screw and a waterproof quick connector.

6. The light source module according to item 5, wherein the LED light source is fixed to the platform, and graphene-containing heat-conducting silicone grease is coated between the LED light source and the platform.

7. The light source module according to any one of items 1 to 5, wherein the graphene phase-change material is poured into a hollow portion of the sunflower radiator, and is solidified to form the block structure.

8. The light source module according to item 7, wherein the hollow portion of the sunflower radiator is sealed by the platform and the back cover.

9. The light source module according to any one of items 5 to 8, wherein the lens is fastened to the sealing rubber ring, and the pressing ring is fixed to the platform by the screw, so as to closely attach the lens and the sealing rubber ring to the platform.

10. An LED module assembly, comprising:

an LED light source module according to any one of items 1 to 9 and a power supply module.

11. The LED module assembly according to item 10, wherein the number of the LED light source modules is one or 2 or more.

12. A graphene heat-dissipation LED lamp, comprising:

an LED module assembly according to item 10 or 11 and a lamp housing.

13. The graphene heat-dissipation LED lamp according to item 12, wherein when the number of the LED light source modules is 2 or more, the LED light source modules are connected to the power supply module through a waterproof power strip.

14. The graphene heat-dissipation LED lamp according to item 12 or 13, wherein the LED module assembly is fixed to the lamp housing by a screw and a presser to form an LED street lamp base.

The graphene heat-dissipation LED lamp provided in the present invention comprises an LED light source module, a power supply module, a lamp housing and an optional waterproof power strip.

When the number of the LED light source modules is 2 or more, the LED light source modules are connected to the power supply module through the waterproof power strip to form an LED module assembly.

When the number of the light source module is one, the LED light source module and the power supply module are connected directly to form an LED module assembly.

In a specific embodiment, the LED light source module comprises a sunflower radiator.

In a specific embodiment, a block structure formed of a graphene phase-change material is filled in the middle of the sunflower radiator.

In a specific embodiment, the surface of the sunflower radiator is coated with a graphene-containing fluororesin material.

In a specific embodiment, in the LED light source module, the LED light source of the LED light source module is connected to the sunflower radiator through graphene-containing heat-conducting silicone grease.

In a specific embodiment, the LED module assembly is fixed to the lamp housing by one or 2 or more screws and pressers to form an LED street lamp base.

In a specific embodiment, the number of the LED light source modules can be several, for example, one, two, three, four, five, six or more.

In a specific embodiment, the LED light source module comprises a lens, a rubber ring, a pressure ring, an LED light source, a sunflower radiator, a back cover, a platform, a block structure formed of a graphene phase-change material, a screw and a waterproof quick connector.

In a specific embodiment, in the LED light source module, the LED light source is fixed to the platform of the sunflower radiator, and the graphene-containing heat-conducting silicone grease is coated between the LED light source and the platform.

In a specific embodiment, the sunflower radiator is a hollow heat-dissipating structure with toothed radial fins, and the graphene phase-change material is poured into the hollow portion of the sunflower radiator and is solidified to form the block structure.

In a specific embodiment, the hollow portion of the sunflower radiator is sealed by the platform and the back cover.

In a specific embodiment, the lens is fastened to the sealing rubber ring, and the pressing ring is fixed to the sunflower radiator platform by screws, so as to closely attach the lens and the sealing rubber ring to the sunflower radiator platform.

In a specific embodiment, the waterproof quick connector connects the light source to the waterproof quick connector of the power supply through a waterproof through hole reserved in the sunflower radiator.

Beneficial Technical Effects

The present invention provides a new LED light source module, an LED module assembly, and a graphene heat-dissipation LED lamp. The present invention adds several types of graphene-containing heat-dissipating materials to the LED module, so as to improve its heat conduction efficiency and prolong its service life. In addition, the LED light source module, the LED module assembly and the graphene heat-dissipation LED lamp of the present invention further improve the lighting performance of the LED lamp. In contrast to the inconvenience in the disassembly and replacement of traditional street lamps, the present invention can be quickly installed without a disassembling tool, by providing standalone modules and using a quick connector.

DETAILED DESCRIPTION OF THE EMBODIMENTS

Figure 1:
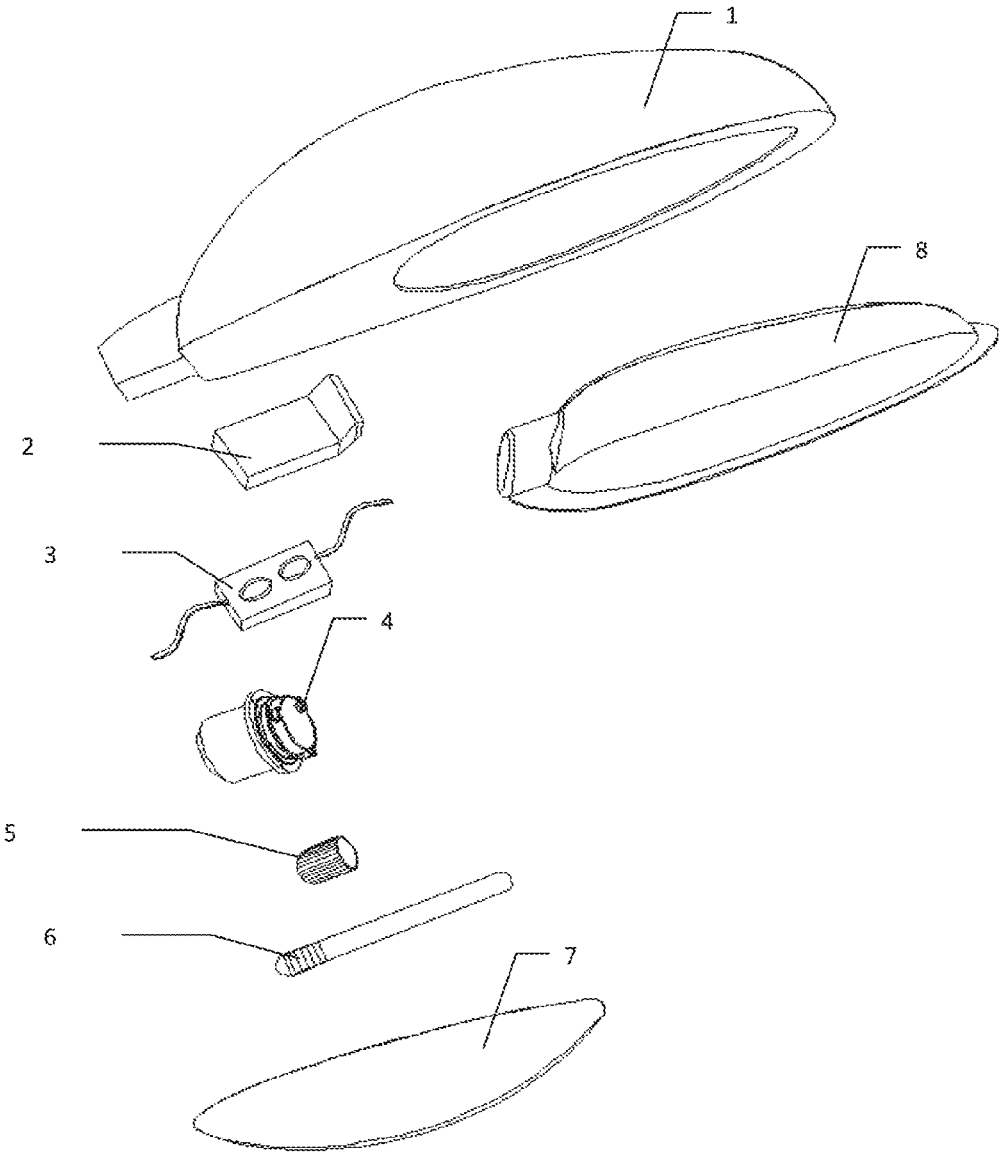
FIG. 1 is an overall schematic diagram of a high-pressure sodium lamp in the prior art.
Figure 2:
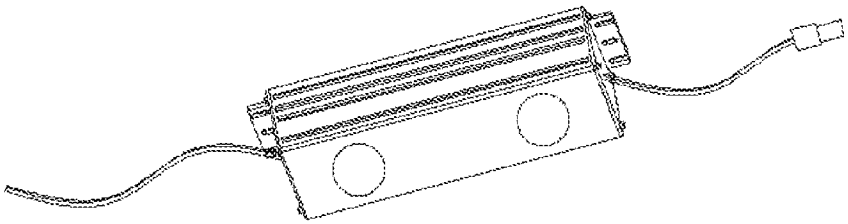
FIG. 2 is a schematic diagram of a ballast of a traditional sodium lamp.

The graphene heat-dissipation LED lamp provided by the present invention comprises one or 2 or more LED light source modules and a power supply module, a lamp housing and an optional waterproof power strip.

When the number of the light source modules is one, the LED light source module and the power supply module are connected to form an LED module assembly.

Two or more light source modules are connected to the power supply module through the waterproof power strip to form an LED module assembly.

The LED module assembly is fixed to the lamp housing by several screws and pressers to form an LED street lamp base.

The number of the LED light source modules is preferentially one to six.

The LED light source module comprises a lens, a rubber ring, a pressure ring, an LED light source, graphene-containing heat-conducting silicone grease, a sunflower radiator containing a graphene coating, a back cover, a platform, a block structure formed of a graphene phase-change material, a screw and a waterproof quick connector.

The sunflower radiator is a hollow heat-dissipating structure with toothed radial fins. The graphene phase-change material is poured into a hollow portion of the sunflower radiator and is solidified to form a cylinder, and the hollow portion of the sunflower radiator will be sealed by the platform and the back cover. The light source is fixed on the platform of the sunflower radiator by screws. A heat-conducting silicone grease composition prepared using a graphene-containing material is applied between the light source and the platform. This heat-conducting silicone grease composition will connect the light source and the sunflower radiator platform closely after solidification. The lens is fastened to the sealing rubber ring, and the pressing ring is fixed to the sunflower radiator platform by screws, so as to closely attach the lens and the sealing rubber ring to the sunflower radiator platform. The waterproof quick connector connects the light source to the waterproof quick connector of the power supply through a waterproof through hole reserved in the sunflower radiator. The one or 2 or more light source modules are fixed to a light source liner plate by screws with washers and elastic pads.

The lens is a high borosilicate glass lens which has a light transmittance of up to about 95% and can reduce the LED light loss.

The light source provided by the present invention is a COB light source. The light source and the platform of the sunflower radiator are connected by graphene-containing heat-conducting silicone grease, so that the temperature difference between the radiator and the light source is controlled within 2° C., the heat conduction efficiency of the LED chip is greatly improved, and the temperature of the light source chip can be maintained within a good range, thereby reducing the light decay of the LED chip and prolonging the service life of the LED.

The graphene-containing heat-conducting silicone grease composition will solidify after bonding, and will have stable properties which are insusceptible to the influences of external environment, so that the light source chip and the radiator can be closely connected. On the other hand, the state of ordinary heat-conducting silicone grease tends to be affected by temperature, which results in dissociation and thereby causes a gap between the chip and the heat-dissipating platform, which reduces the heat dissipation efficiency. Generally, the heat dissipation coefficient of the graphene-containing heat-conducting silicone grease is 3.0 W/m·k or greater, while the heat dissipation coefficient of the traditional heat-conducting silicone grease is only about LOW/m·k, so that the use of the graphene-containing heat-conducting silicone grease can increase the heat transfer performance by more than 1.5 times. The service life of the graphene-containing heat-conducting silicone grease is about 10 years. This is much longer than that of the traditional heat-conducting silicone grease, which is about 2 years. Therefore, the use of the graphene-containing heat-conducting silicone grease enables the sunflower radiator to better dissipate the heat of the light source. The use of the graphene-containing heat-conducting silicone grease material has already been disclosed in the applicant's prior patent CN2012/10119361.9 and is not described in detail herein, and the disclosure of CN2012/10119361.9 is incorporated herein by reference.

In the present invention, a graphene phase-change nano material for heat storage is built in the cavity of the sunflower radiator, and the graphene phase-change material can also realize the effects of heat storage and temperature unification, thereby further improving the heat dissipation efficiency of the radiator. The graphene phase-change nano material for heat storage provided by the present invention has already been disclosed in the applicant's prior patent CN2013/10714156.1, and the inner phase-change layer used in that patent is prepared using various existing phase-change materials, including solid-liquid phase-change materials, liquid-gas phase-change materials, solid-solid phase-change materials and solid-gas phase-change materials, the specific material being organic or inorganic. It is preferable to use a solid-liquid phase-change material, which can be realized by simply storing the solid-liquid phase-change material in the phase-change layer, and the phase-change material has the property of changing form with temperature while providing latent heat. In a process referred to as phase change where the phase-change material changes its state from solid to liquid or from liquid to solid, the phase-change material will absorb or release a large amount of latent heat. The disclosure of CN2013/10714156.1 is incorporated herein by reference. The phase-change material has the ability to change its physical state within a certain temperature range, so that it can maintain a certain temperature for a long time. The phase-change temperature range of the solid-liquid phase-change material is 0-200° C., and the material is preferably one or more of the following phase-change materials: paraffin, microcrystalline wax, liquid paraffin, polyethylene wax, semi-refined paraffin, and polyethylene glycol 6000, etc.

The surface of the sunflower radiator provided by the present invention is coated with a graphene-containing fluororesin composite material (also referred to as a RLCP graphene-fluororesin composite material) to enhance infrared radiation and improve the heat dissipation efficiency. The radiation coefficient of the surface of an ordinary radiator is 0.2. After adding a coating of the RLCP graphene-fluororesin composite material, the radiation coefficient increases to 0.7, and the outward radiation and heat storage are greatly enhanced. The RLCP graphene-fluororesin composite material used has already been disclosed in the applicant's prior patent CN2013/10089504.0, and will not be described in detail herein. The disclosure of CN2013/10089504.0 is incorporated herein by reference.

The power supply module comprises a power supply and a power supply liner plate. The power supply and the power supply liner plate are connected by screws to form a power supply module.

In the LED module provided by the present invention, three different types of graphene heat-conducting materials are added, so that the heat conduction efficiency of the whole LED is improved, the product performance of the LED module is improved by about 30% compared with traditional LED lamps, and, in combination with the highly efficient and energy-saving characteristics of the LED, the light efficiency is improved by 200% compared with traditional sodium lamps.

The international protection marking of the whole LED lamp provided by the present invention can easily reach IP67 through the use of waterproof quick connectors, sealing rings, pressing rings, etc., which can ensure the normal operation of the lamps in various environments. In the present invention, the light source and the power supply provided respectively as independent modules. In contrary to the traditional LED lamps in which many components are fixedly connected to each other, the LED light source module and the power supply module in the present invention are connected to each other by a quick connector, thus having the advantages of convenient installation and easy maintenance. In addition, the use of a sunflower radiator with high heat conduction efficiency, the heat dissipation efficiency of the entire lamp can be further improved.

The embodiments of the present invention will be described in detail below with reference to the examples and the accompanying drawings, so that the implementation process in which the technical means of the present invention are applied to solve the technical problems and the technical effects are achieved can be comprehensively understood and realized.

Figure 3:
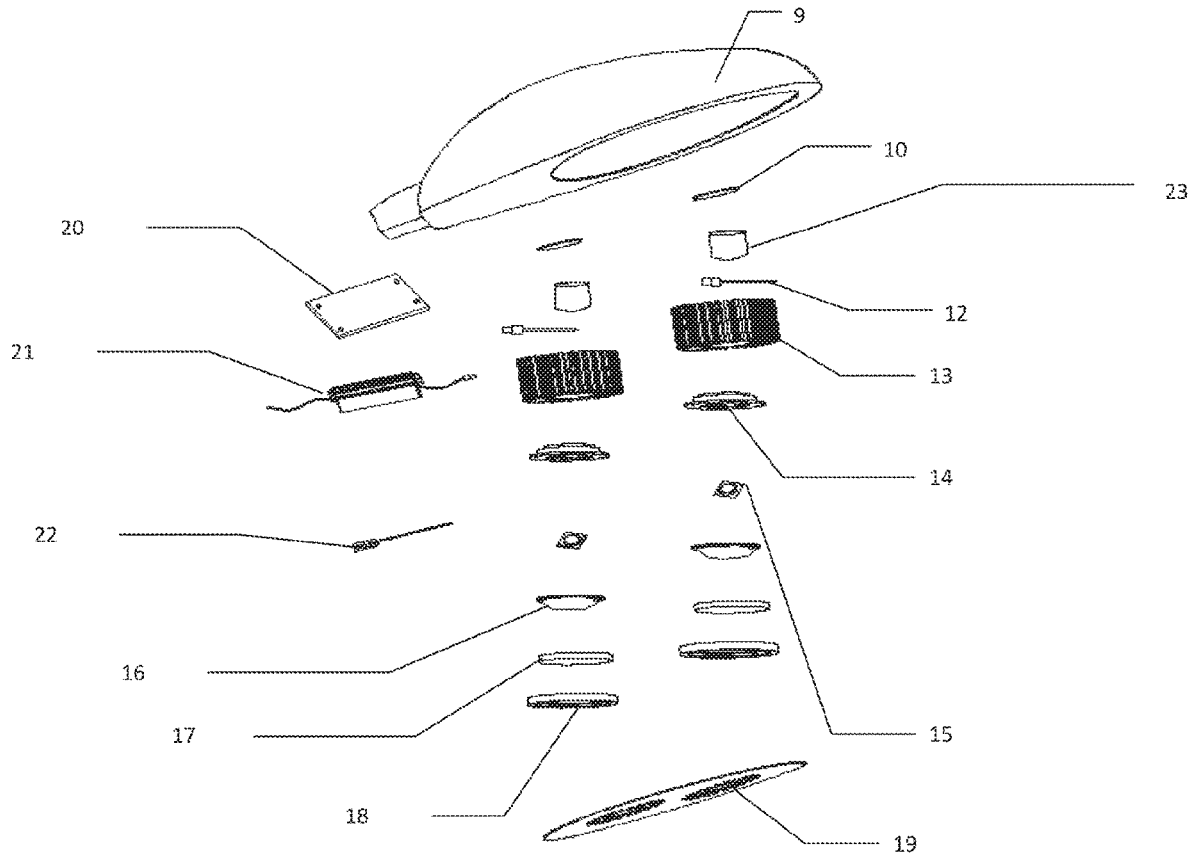
FIG. 3 is a schematic overall exploded view of a graphene heat-dissipation LED lamp of the present invention.
Figure 5:
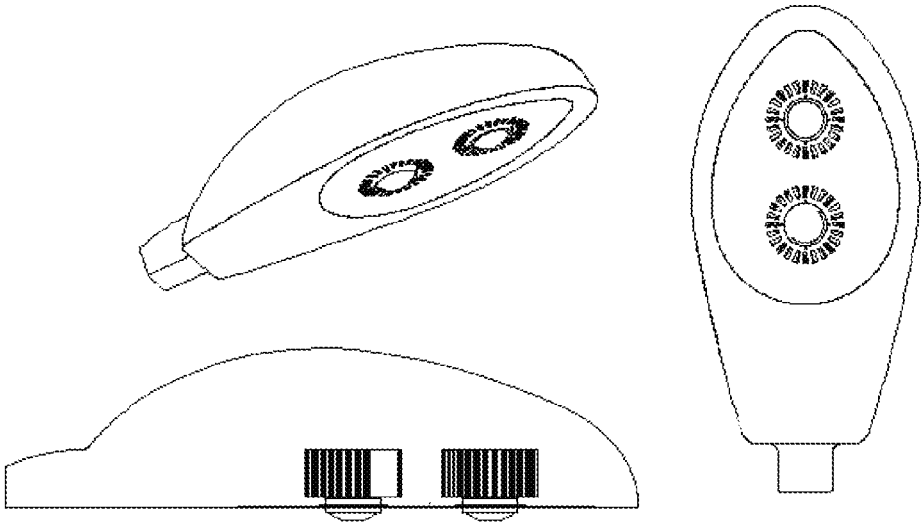
FIG. 5 is a schematic diagram of the sodium lamp after retrofitting.

As shown in FIG. 3 and FIG. 5, in the graphene heat-dissipation LED lamp provided by the present invention, the graphene heat-dissipation LED lamp comprises two LED light source modules and a power supply module (wherein the power supply module comprises a driving power supply 21 and a power supply liner plate 20), a lamp housing 9 and a waterproof power strip 22, wherein the two LED light source modules are located inside the lamp housing. The light source module is connected to the power supply module through the waterproof power strip 22 to form an LED module assembly. The LED module assembly is fixed to the lamp housing by screws and pressers to form an LED street lamp base. As shown in FIG. 5, the number of the LED light source modules is two. In addition, as shown in FIG. 3, the two LED light source modules are fixed inside the lamp housing 9 by a tray 19.

The LED light source module comprises a lens 16, a rubber ring 17, a pressure ring 18, an LED light source 15, a graphene-containing heat-conducting silicone grease, a sunflower radiator 13, a back cover 10, a platform 14, a graphene phase-change material 23, a screw and a waterproof quick connector 12.

When installing the graphene heat-dissipation LED lamp provided by the present invention, the waterproof quick connector 12 in the LED light source module is connected to the waterproof power strip 22, and the waterproof quick connectors 12 in several light source modules are usually connected to one and the same waterproof power strip 22.

FIG. 3 shows a case where two light source modules are included. It can be understood by those skilled in the art that when the number of the light source module is one, the light source module is directly connected to the power supply module.

Figure 4:
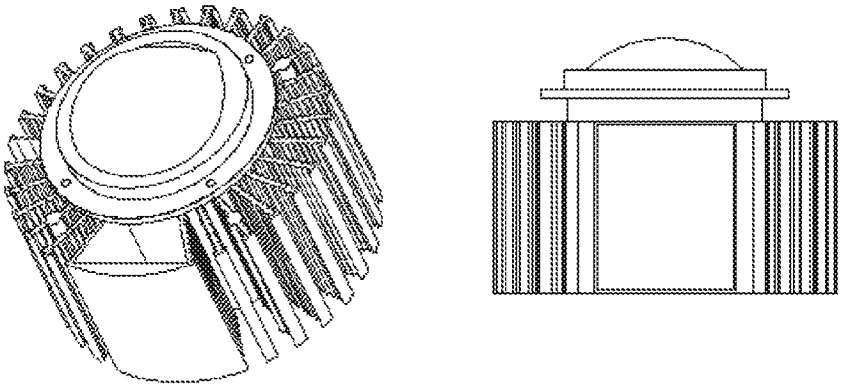
FIG. 4 is an overall schematic diagram of a light source module of the present invention.

The sunflower radiator 13 is a hollow heat-dissipating structure with toothed radial fins. The graphene phase-change material 23 is poured into a hollow portion of the sunflower radiator and is solidified to form a cylinder, and the hollow portion of the sunflower radiator 13 will be sealed by the platform 14 and the back cover 10. The LED light source 15 is fixed on the platform 14 of the sunflower radiator by screws, and the heat-conducting silicone grease prepared by a graphene material is applied between the light source and the platform. After solidification, this heat-conducting silicone grease will connect the light source and the sunflower radiator platform closely. The lens 16 is fastened to the sealing rubber ring 17, and the pressing ring 18 is fixed to the sunflower radiator 13 platform by screws, so as to closely attach the lens 16 and the sealing rubber ring 17 to the sunflower radiator platform 14. The waterproof quick connector 12 connects the light source to the waterproof power strip 22 of the power supply through a waterproof through hole reserved in the sunflower radiator 13. The light source modules are fixed to the light source liner plate by screws with washers and spring pads. FIG. 4 is an overall schematic diagram of the LED light source module after assembling.

EXAMPLES

The materials used in the following examples are as follows, which are commercially available.

The graphene phase-change material is specifically prepared as follows:

the additive components used and their mass ratios are: carbon nanotubes, graphene, particulates, and fumed silica at a mass ratio of 1:10:8:1, and the mass ratio of all the additive components to the phase-change material described later is 1:4.

The purity of the carbon nanotubes is >95 wt %, and the ash content is <0.2 wt %.

The particulate is alumina ($Al_2O_3$) and the average particle size is 10 μm.

The phase-change material is paraffin and the phase-change temperature is 70° C.

The paraffin was heated to complete melting, and then carbon nanotubes, graphene and particulates at a mass ratio of 1:10:8 are poured into the paraffin melt liquid for premixing. The mixture was stirred until homogeneously mixed, fumed silica of the required mass was added slowly; it was further stirred until homogeneously mixed, and the eventual phase-change material is obtained after cooling down.

The graphene-containing heat-conducting silicone grease is specifically prepared as follows:

the additive components used and their mass ratios are: carbon nanotubes, graphene, and particulates at a mass ratio of 1:6:3, and the volume ratio of all additive components to silicone oil is 6:4.

The purity of the carbon nanotubes is >95 wt %, and the ash content is <0.2 wt %.

The particulate is a paraffin-coated phase-change capsule, and the paraffin-coated material is alumina with a phase-change temperature of 29° C. and an average particle size of 60 μm.

The silicone oil is a mixture of dimethicone and hydrogen-containing silicone oil, with a viscosity of 500,000 cSt at 25° C.

Preparation Method

The graphene and particulates at a mass ratio of 6:3 were poured into a small amount of silicone oil for premixing, and under the condition of mechanical stirring, carbon nanotubes of the required mass were slowly added, and silicone oil was replenished as needed until the required content of silicone oil was reached. After mechanical stirring for further half an hour, the mixture was milled for one hour using a roller mill to obtain the eventual silicone grease.

The RLCP graphene-fluororesin composite material was specifically prepared as follows:

A target coating material was formed by mixing the following materials (by mass percent) in steps and stirring them evenly under the condition of 800-1000 rpm at room temperature: 50% fluorosilicone resin (provided by Shanghai Huiyan New Materials Co., Ltd), 40% acrylic thinner, 4% electron-transferring organic compound of polypropylene, 1% graphene, 1% carbon nanotube, 1% titanium dioxide, and 3% a curing agent of epoxy resin.

In the following examples, the RLCP graphene-fluororesin composite material was applied to the surface of the sunflower radiator by the following method:

performing degreasing and decontamination treatments on the surface of the radiator to be sprayed, fully stirring the target coating material and then pouring it into a spray gun, setting the pressure of the spray gun to 0.4 MPa, aiming at the target surface at a distance of 10-20 cm, and spraying it two to three times to make the coating evenly cover the surface of the object. The coating was even and glossy, and its thickness could be optimized as required. The coating could be naturally air-dried for 12 hours or baked in an oven for 10 minutes for quick solidification.

The light source used in the following examples is a COB light source.

Example 1 LED Lamp Containing Graphene Heat-Conducting Silicone Grease

Comparative sample: a 160*70 mm sunflower radiator of reference design and a 30 W integrated light source were used, the light source and the platform being connected by a thermal paste from Thermalright, Taiwan, with no surface treatment for the cavity interior and the heat sink.

Experimental sample: a 160*70 mm sunflower radiator of reference design identical to the comparative sample, and a 30 W integrated light source identical to the comparative sample were used, the light source and the platform being connected by the above-mentioned graphene-containing heat-conducting silicone grease, with no surface treatment for the cavity interior and the heat sink.

Example 2 LED Lamp Containing Graphene Phase-Change Material

Comparative sample: the above-mentioned 160*70 mm sunflower radiator of reference design and the above-mentioned 30 W integrated light source were used, the light source and the platform being connected by the above-mentioned thermal paste from Thermalright, Taiwan, with no surface treatment for the cavity interior and the heat sink.

Experimental sample: the above-mentioned 160*70 mm sunflower radiator of reference design and the above-mentioned 30 W integrated light source were used, the light source and the platform being connected by the above-mentioned thermal paste from Thermalright, Taiwan, with no surface treatment for the heat sink, but the sunflower cavity being filled with the above-mentioned graphene phase-change material.

Example 3 LED Lamp Containing a Coating of Graphene-Fluororesin Material

Comparative sample: the above-mentioned 160*70 mm sunflower radiator of reference design and a 90 W integrated light source were used, the light source and the platform being connected by the above-mentioned thermal paste from Thermalright, Taiwan, with no surface treatment for the cavity interior and the heat sink.

Experimental sample: the above-mentioned 160*70 mm sunflower radiator of reference design and the above-mentioned 90 W integrated light source were used, the light source and the platform being connected by the above-mentioned thermal paste from Thermalright, Taiwan, with no treatment for the cavity interior, but the surface of the radiator being sprayed with 100 μm of the above-mentioned RLCP graphene-fluororesin composite material.

Example 4 LED Lamp Containing the Composite of Three Graphene Materials

Experimental sample: the above-mentioned 160*70 mm sunflower radiator of reference design and the above-mentioned 90 W integrated light source were used, the light source and the platform being connected by the above-mentioned graphene-containing heat-conducting silicone grease, the sunflower cavity being filled with the above-mentioned graphene phase-change material which was then solidified, and the surface of the radiator being sprayed with 100 μm of the above-mentioned graphene heat-dissipating coating.

The following tests were carried out for the experimental samples and comparative samples in Examples 1 to 4.

The experimental instruments used in the tests are as follows:

1) DRL-III heat conductivity meter, which is used to test the heat conductivity of a material according to standard MIL-I-49456A.

2) AT4532 high-precision multi-channel temperature meter, which is used to simultaneously monitor the temperatures of multiple points in real time.

3) FLIR T420 infrared thermal imaging camera, which can produce a clear image under in dark night without light source, and can measure temperature in a non-contact mode.

Test Methods

1) The heat transfer performance of the graphene-containing heat-conducting silicone grease was directly tested and compared using GB10297-88: a test method for heat conductivity coefficient of a non-metallic group material (the hot line method).

2) The heat transfer performances of the comparative sample and the experimental sample in Example 1 were tested under the following conditions: for a 30 W integrated LED integrated chip, the light source was kept on for 40 minutes at the room temperature of 20° C. and the humidity of 45%.

3) The heat flux dilution effects of the comparative sample and the experimental sample in Example 2 were tested under the following conditions: recording the chip temperature when it was substantially stable (40 minutes), at the room temperature of 20° C. and the humidity of 45%, in order to test the temperature unification performance of the graphene phase-change material.

4) The heat radiation exchange effects of the comparative sample and the experimental sample in Example 3 were tested under the following conditions: recording the chip temperature when it was substantially stable (40 minutes), at the room temperature of 20° C. and the humidity of 45%, in order to test the cooling performance of the graphene heat-dissipating coating by radiation.

5) The heat dissipation of the experimental sample in Example 4 was tested under the following conditions: recording the chip temperature when it was substantially stable (40 minutes) at the room temperature of 20° C. and the humidity of 45%.

The test results are summarized as follows:

The performance of the graphene-containing heat-conducting silicone grease and the Thermalright thermal paste used in the examples were compared using the GB10297-88 method.

| | Graphene-containing heat-conducting silicone grease | Thermalright thermal paste |
|---|---|---|
| Appearance | Chocolate colour | Grey |
| Density (g/cm$^3$) | 3.2 | 2.8 |
| Volatilization rate (%) | None | 0.9 |
| Heat conductivity coefficient (w/mk) | 4.2391 | 3.9212 |
| Contact thermal resistance (m$^2$k/w) | 0.000012 | 0.000024 |

When reaching a steady state after 40 minutes, the experimental sample of Example 1 had a chip temperature of 34.7° C. and a heat sink temperature of 34.8° C., while the comparative sample of Example 1 had a chip temperature of 36.8° C. and a heat sink temperature of 36.8° C. It can be seen that, compared with the Thermalright thermal paste, the graphene-containing heat-conducting silicone grease in the same time reduced the chip temperature by 2° C. further, which was basically consistent with the data obtained by the heat conductivity coefficient measurement method.

Further, the experimental sample and the comparative sample of Example 2 were tested according to the above-mentioned test conditions. When reaching a steady state after 40 minutes, the chip temperature of the comparative sample was 41° C. and the temperature difference between the chip and the fins was 3° C., while the chip temperature of the experimental sample was only 38° C., and there was no temperature difference between the chip and the fins.

Further, the experimental sample and the comparative sample of Example 3 were tested according to the above-mentioned test conditions. The temperature rise of the chip in the sunflower heat dissipation system of the experimental sample of Example 3 was significantly slower than that of the comparative sample. Compared with the comparative sample, the final temperature of the experimental sample was 7° C. lower, which means that the system has a higher heat dissipation capability after the material of the present invention is sprayed. The surface temperature of the heat sink of the experimental sample was about 3° C. higher than the surface temperature of the heat sink that was not sprayed. It can be seen from the temperature difference between the chip and the heat sink that the temperature difference for the experimental samples is about 1° C., and the temperature difference for the comparative samples is up to 10.6° C. It is indicated that the sunflower heat dissipation system sprayed with the graphene-containing fluororesin material of the present invention has a better heat radiation capability and lowers the temperature of the LED chip.

Further, the sample of Example 4 was tested, and the temperature rise of the substrate of the 90 W integrated light source was only 31.6° C. after reaching a steady state. The temperature difference between the substrate and the lowest temperature of the heat sink was in the range of 1° C., and the temperature uniformity was excellent.

The surface of the sunflower radiator in this example is coated with a RLCP graphene-fluororesin composite material so as to be able to enhance infrared radiation, and the experimental results showed that the application of the coating had significantly improved the heat dissipation efficiency. The radiation coefficient of the surface of an ordinary radiator is 0.2. After adding a graphene coating, the radiation coefficient increases to 0.7, and the outward radiation and heat storage are greatly enhanced.

In this example, the graphene phase-change nano material for heat storage is built in the cavity of the sunflower radiator, and according to the experimental results, the heat dissipation efficiency of the radiator can be further improved by using the phase-change material, and the volume of the radiator is reduced under the same heat dissipation condition, making the LED module lighter and easier to install.

The light source module provided by the present invention adds three types of graphene heat-conducting materials through encapsulation, so that the heat conduction efficiency of the whole LED is improved, and the light efficiency is increased by 200% compared with traditional sodium lamps, or by about 30% compared with traditional LED lamps.

All of the above-mentioned primary implementations of this intellectual property are not set to limit other forms of implementation of this new product and/or new method. Those skilled in the art will utilize this important information to modify the above contents to achieve similar implementation. However, the rights of all modifications or changes based on the new products of the present invention are reserved.

The contents above are only preferred embodiments of the present invention, and are not intended to limit the present invention in any way. Any person skilled in the art may change or modify the technical contents disclosed above into equivalent embodiments with equivalent variations. However, any simple modifications, equivalent variations and remoulding made to the above embodiments in accordance with the technical essence of the present invention without departing from the content of the technical solutions of the present invention are still within the scope of protection of the technical solutions of the present invention.

The invention claimed is:

1. An LED light source module, comprising a sunflower radiator and an LED light source;

wherein a block structure formed of a graphene phase-change material is filled in the middle of the sunflower radiator;

wherein the surface of the sunflower radiator is coated with a graphene-containing fluororesin material;

wherein the LED light source is connected to the sunflower radiator through graphene-containing heat-conducting silicone grease;

wherein the LED light source module further comprises a lens, a rubber ring, a pressing ring, a back cover, a platform, a screw and a waterproof quick connector;

wherein the waterproof quick connector connects the light source to a waterproof power strip of a power supply module through a waterproof through hole reserved in the sunflower radiator;

wherein the LED light source is fixed to the platform of the sunflower radiator, and graphene-containing heat-conducting silicone grease is coated between the LED light source and the platform; and wherein the lens is fastened to the sealing rubber ring, and the pressing ring is fixed to the platform by the screw, so as to closely attach the lens and the sealing rubber ring to the platform.

2. The LED light source module according to claim 1, wherein the graphene phase-change material is poured into a hollow portion of the sunflower radiator, and is solidified to form a block structure.

3. The LED light source module according to claim 2, wherein the hollow portion of the sunflower radiator is sealed by the platform and the back cover.

4. The LED light source module according to claim 1, wherein a temperature difference between the radiator and the light source is controlled within 2° C.

5. An LED module assembly comprising the LED light source module to claim 1, wherein the number of the LED light source modules is one or two or more.

6. A graphene heat-dissipation LED lamp, comprising the LED module assembly according to claim 5 and a lamp housing.

7. The graphene heat-dissipation LED lamp according to claim 6, wherein when the number of the LED light source modules is 2 or more, the LED light source modules are connected to the power supply module through a waterproof power strip.

8. The graphene heat-dissipation LED lamp according to claim 6, wherein the LED module assembly is fixed to the lamp housing by a screw and a presser to form an LED street lamp base.

9. The LED light source module according to claim 1, wherein the graphene phase-change material improves heat conduction change material which improves heat conduction efficiency of the light source and prolongs a service life of the source.

10. The LED light source module according to claim 1, wherein when the number of the light source module is one, the LED light source module and the power supply module are connected directly to form an LED module assembly.

11. The LED light source module according to claim 1, wherein after adding a coating of the graphene-fluororesin composite material to the surface of the sunflower radiator a radiation coefficient increases to 0.7.

* * * * *